United States Patent [19]

Adams

[11] 3,961,454

[45] June 8, 1976

[54] PREFABRICATED INSULATION PANEL

[76] Inventor: Howard C. Adams, Apt. C-14, 120 Malibu Drive, Clarksville, Tenn. 37040

[22] Filed: Oct. 16, 1972

[21] Appl. No.: 297,782

[52] U.S. Cl. ..... 52/527; 52/404; 52/542; 52/549

[51] Int. Cl.² ..... E04D 1/00

[58] Field of Search ..... 52/406, 408, 409, 404, 52/478, 518, 519, 528, 537, 540, 542–544, 588, 508, 474, 615, 235, 619, 521, 510, 527, 556, 592, 549, 533, 407

[56] References Cited

UNITED STATES PATENTS

| | | | |
|---|---|---|---|
| 715,156 | 12/1902 | Satterfield | 52/592 |
| 2,211,644 | 8/1940 | Buck et al | 52/619 |
| 3,355,203 | 11/1967 | Stauffer | 52/404 X |
| 3,412,518 | 11/1968 | Waite | 52/404 |
| 3,555,756 | 1/1971 | Curran et al | 52/478 X |
| 3,555,761 | 1/1971 | Rosebrough | 52/542 |

FOREIGN PATENTS OR APPLICATIONS

| | | | |
|---|---|---|---|
| 626,690 | 10/1961 | Italy | 52/615 |

*Primary Examiner*—Ernest R. Purser
*Assistant Examiner*—Carl D. Friedman
*Attorney, Agent, or Firm*—Harrington A. Lackey

[57] ABSTRACT

A prefabricated insulation panel including a face member of imperforate sheet material having a top flange with an upright attaching flange at the rear thereof, an inside foot flange spaced above the bottom edge of the face member defining a lapping bottom portion, and insulation material received and retained against the inside of the face member between the top flange and foot flange.

4 Claims, 5 Drawing Figures

PREFABRICATED INSULATION PANEL

BACKGROUND OF THE INVENTION

This invention relates to a building panel, and more particularily to a prefabricated insulation panel.

Heretofore insulation panels have been developed including thick insulation materials sandwiched or laminated between a pair of outer sheet or skin members. However, the means for securing the panels to the outside of the building structure incorporate screws or nails which penetrate the skins as well as the insulating members. The punctured holes in the panels thus create deformed panels, deterioration of the insulating material, and some loss of thermal insulating quality.

These disadvantages are particularily apparent in insulating panels used in the insulation of heating apparatus, such as large boilers, boiler auxiliary components and heating ducts.

SUMMARY OF THE INVENTION

It is therefore an object of this invention to provide a prefabricated insulation panel of more stable structural qualities and better adapted for assembly, than previous insulation panels.

The insulation panel made in accordance with this invention includes a face member of imperforate sheet material, such as sheet metal, having a top flange integrally formed with and projecting from the rear edge of the face member and terminating in an upstanding attaching flange. The bottom portion of the face member includes an inwardly upturned portion defining a foot flange projecting rearward from the face member and spaced above the turned bottom edge, the foot flange being connected by the upturned integral portion of the face member to the bottom edge. An insulation member or pad of corresponding configuration is fitted against the rear surface of the face member between the top flange and the foot flange, and held in position by any convenient securing means. The bottom portion of the face member between the foot flange and the bottom edge forms a lapping portion adapted to overlap the top portion of the face member of a subjacent panel, while the foot flange rests upon the top flange of the subjacent panel. The attaching flange is preferably in vertical alignment with the rear of the panel and projects above the panel, so that it may be easily attached to the structure covered by the panels.

The overall coverage of the imperforate sheet material of not only the face member but the top flange, foot flange and the connecting flange, is more than adequate protection of the insulation material from weather and mechanical damage, as well as protection of the interior of the covered structure from the weather.

The foot flange not only forms a ledge for seating against the top flange of the subjacent panel, and for accurate spacing of the panels, but also protects the insulation material from any creeping moisture which might penetrate beneath and inside the overlapping bottom portion.

The top flange, being equal to the depth of the panel, forms a self reinforcing web to strengthen the panel against external force or pressure, particularily when used horizontally, such as a roof panel.

DESCRIPTION OF THE PREFERRED EMBODIMENTS

Figure 1:
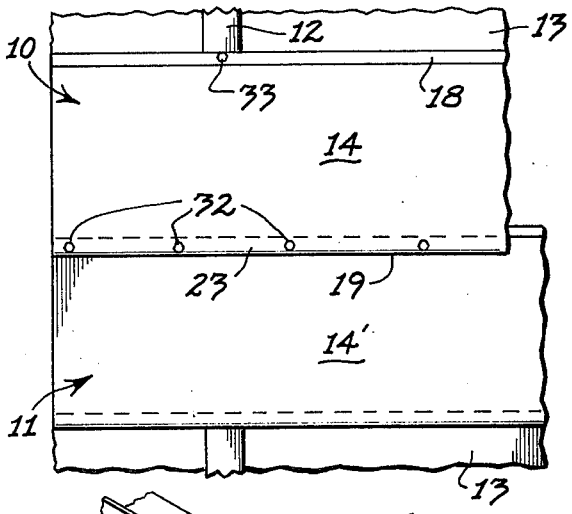
FIG. 1 is a fragmentary front elevation of a pair of overlapping panels made in accordance with this invention.
Figure 2:
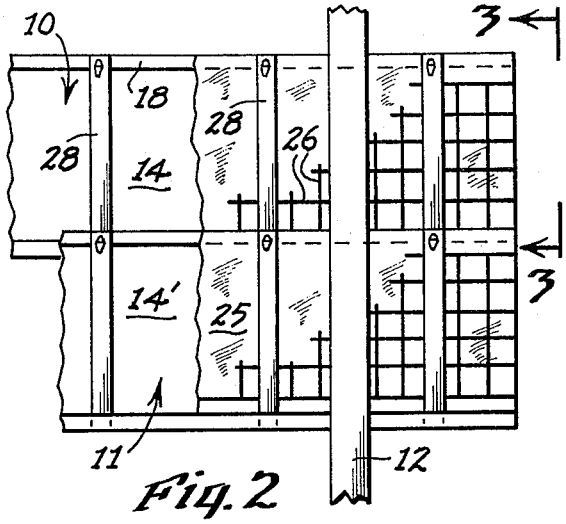
FIG. 2 is a fragmentary rear elevation of the panels disclosed in FIG. 1, with portions broken away.
Figure 3:
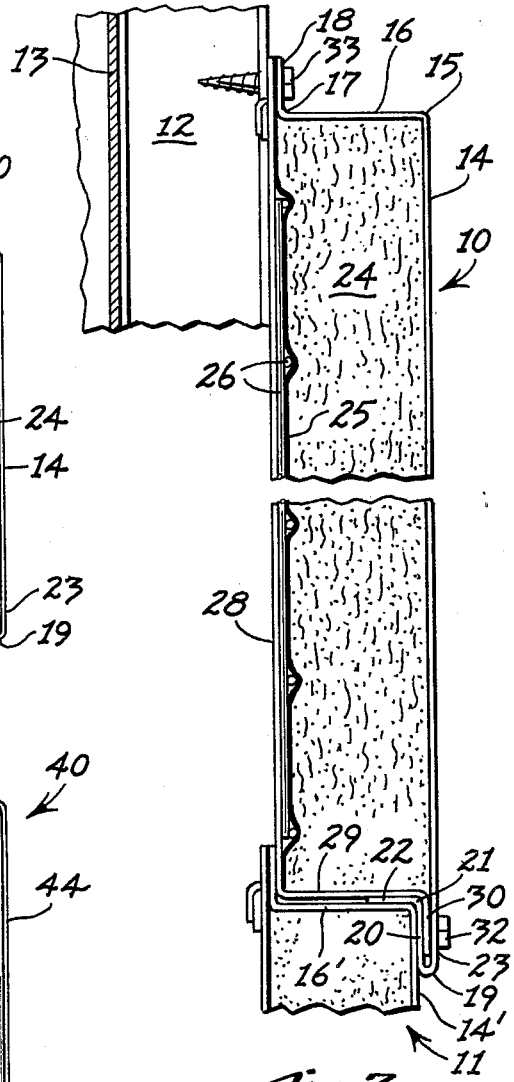
FIG. 3 is an enlarged view taken along line 3 — 3 of FIG. 2.

Referring to the drawings in more detail, FIGS. 1, 2 and 3 disclose a pair of panels 10 and 11 assembled in overlapping relationship upon a stiffener member 12 of a large heating duct 13, for example, fragmentarily shown in FIGS. 1 and 3.

Figure 4:
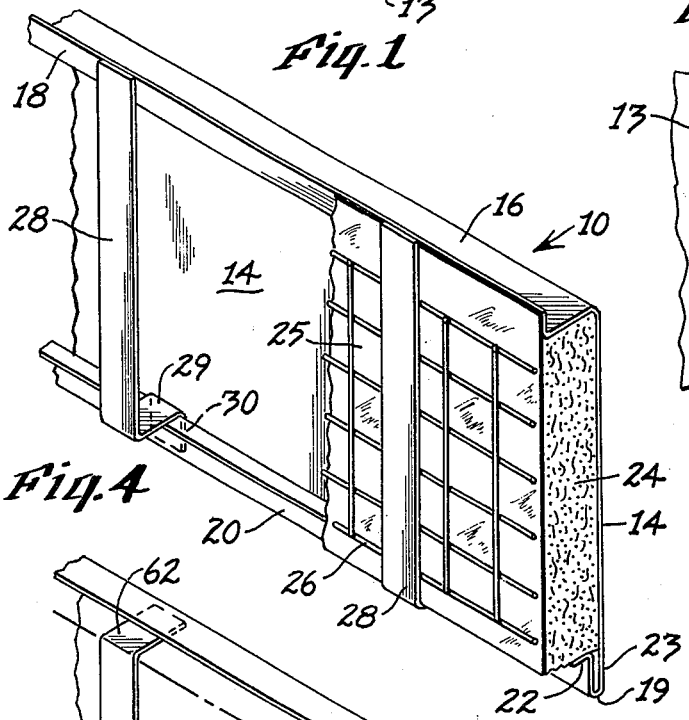
FIG. 4 is a fragmentary rear perspective view, with portions broken away, of a panel made in accordance with the invention disclosed in FIGS. 1 – 3.

As best disclosed in FIGS. 3 and 4, the upper panel 10 is formed of a rectangular-shaped, flat face member 14 of imperforate sheet material, such as galvanized steel or aluminum. The sheet metal, from which the face member 14 is constructed, is preferably bent approximately 90° to form the top edge 15 and projects rearward the full depth of the panel 10 to form the top flange 16. The metal is bent upward at the crease 17 to form an elongated upstanding attaching flange 18, substantially in the plane of the rear face of the panel 10.

In the preferred form of the invention, the bottom edge 19 of the face member 14 is formed by turning the sheet material, from which the face member 14 is made, back upon itself to form an upward projecting connecting flange 20, which is then turned at the crease 21 to project rearward as the foot flange 22. Thus, as clearly illustrated in FIG. 3, the connecting flange 20 and the bottom lapping portion 23 of the face member between the foot flange 22 and bottom edge 19 overlap the upper portion of the face member 14 of the subjacent panel 11.

Fitted within the interior space of the panel 10 formed by the top flange 16, face member 14 and foot flange 22, is a rectangular pad 24 of insulating material. The insulating material pad 24 may have its rear face covered with the reflective foil 25, such as aluminum foil, held in place by the wire grid 26, if desired.

To hold the insulating pad 24 in its insulating or operative position within the panel 10, metal straps 28 may be rigidly secured to the back of the attaching flange 18, by fasteners, or by welding, and bent at their lower ends to form the hook members 29 having depending flanges 30 for wedging between the adjacent lapping portions 20 and 23.

As best illustrated in FIG. 3, when a panel 10 is mounted in assembled position on top of the next lower or subjacent panel 11 of identical construction, the foot flange 22 seats flush upon the top flange 16' of the lower panel 11 with the overlapping flange 20 abutting flush against the upper portion of the face member 14'. The depending flange portions 23 and 20 are firmly secured to the upper portion of the lower panel 11 by an appropriate bolt or screw fastener 32.

The upper attaching flange 18 is easily secured to the stiffener 12 by inserting a threaded fastener 33 therethrough. It will be noted in FIG. 3 that the threaded fastener 33 penetrates only the attaching flange 18, and possibly the upper extension of the metal foil backing 25, but does not penetrate the interior space which accomondates the insulating pad 24. Moreover, the lower fastener 32 does not penetrate any portion of the interior space of the panel 10, or the insulating pad 24 in panel 10. Although the lower fastener 32 does penetrate the face member 14' and a portion of the insulating material behind face member 14', nevertheless, the aperture created by the penetration is covered by the depending flange portions 20 and 23 and by the head of the fastener 32. Furthermore, in some installations, the lower fastener 32 may be eliminated.

Moreover, the fasteners 32 and 33 are easily installed, because the portion of the panel 10 to which they are attached are exposed during installation. Furthermore, when the next panel is placed on top of the panel 10, the lower portion of the upper panel hides the upper fastener 33 in panel 10, and protects it from the weather.

Although the foot flange 22 could project rearward farther than it does in FIG. 3, nevertheless, the rear edge of foot flange 22 preferably terminates a distance substantially forward of the rear face of the panel 10, to minimize heat conduction from the heating duct 13 and the stiffener 12. Since the sheet material from which the face member 14 and the foot flange 20 are made will more than likely be a heat conductive metal, the fore-shortened foot flange 22 is preferred.

Figure 5:
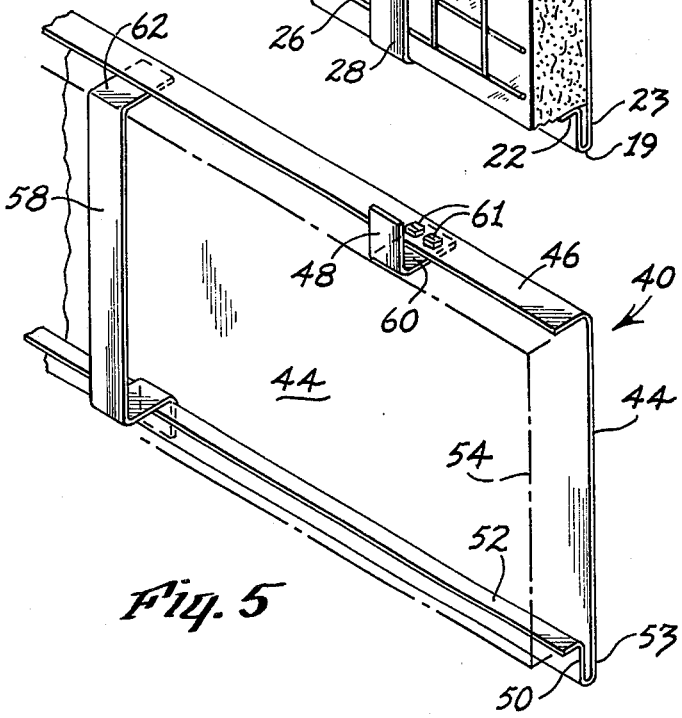
FIG. 5 is a fragmentary rear perspective view of a modified panel, with the insulation pad shown in phantom.

If the heat transfer through the panel is a particular problem, then its structure may be modified to form a panel such as 40, illustrated in FIG. 5. In the panel 40, the face member as well as the insulating pad 54, are identical to their counterparts in panel 10. However, the top flange 46 is fore-shortened, that is, it is not as wide as the thickness of the panel 40, in order to minimize heat-conducting contact with the heating duct 13 or stiffener 12, upon which the panel 40 might be secured. Accordingly, the upstanding attaching flange 48 is secured to the top flange 46 by a forwardly projecting bracket or strap 60 secured by appropriate fastener 61. Thus, the combined depth of the top flange 46 and the bracket strap 60 equals the thickness of the panel 40 to provide the self-reinforcing rigidity to the panel 40. In other words, the bracket strap 60 forms an extension of the top flange 46 with less heat conductiveness than the solid top flange 16. The insulating retainer strap 58 has the same lower structure as the strap 28, but its top edge is bent forward to form a flange 62, secured by means such as welding to the bottom portion of the top flange 46.

It would therefore be apparent that any of the panels 10, 11 or 40 are not only unitary and compact but are structurally stable, as well as providing a more adequate coverage of the insulating pads 24 for maximum weather and mechanical protection. A limited number of fasteners 32 and 33 are provided for firmly securing the panels 10 and 11 to structural members such as 12 so that the assembly is not only rapid but simple. Moreover, the overlapping relationship of the vertical panels 10 and 11 provides protection of the structure to which the panels are secured from the weather and from damage from many types of external objects.

Because of the relative dimensions, location and structure of the top flanges 16, 16' and 46, and the foot flanges 22 and 52, the panels 10, 11 and 14 are self-reinforcing, self-aligning and esthetically pleasing.

What is clamied is:

1. A prefabricated insulation panel adapted to be assembled in overlapping relationship with other like panels upon the outside of a support member of a heating apparatus comprising:

a. a planar face member made of imperforate sheet material having a top edge, a bottom edge, a front exterior surface, and a rear interior surface, b. a top flange fixed to and projecting rearward from said top edge, c. an attaching flange fixed to, and projecting upward above, said top flange, said attaching flange being spaced behind said face member and having a fastener opening therethrough, d. a fastener member adapted to project through said opening and secure said attaching flange to and in front of a support member, said fastener member being substantially behind said face member when secured to said support member, e. a connecting flange integrally connected to the bottom edge of said planar face member comprising a reversely bent extension of said face member and projecting upward immediately behind and parallel to said face member, said connecting flange having an upper end portion, f. a foot flange fixed to and projecting rearward from the upper end portion of said connecting flange substantially parallel to said top flange, said foot flange comprising a bent extension of said connecting flange, g. said foot flange terminating in a rear edge spaced substantially forward of said attaching flange to minimize heat conduction from the support member to the face member, h. said foot flange being spaced above said bottom edge a distance substantially less than the distance between said foot flange and said top flange so that the lower portion of said face member between said foot flange and said bottom edge comprises a lapping portion, i. said lappping portion being adapted to overlap and extend downward in front of the upper portion of the face member of a subjacent panel when said foot flange is seated upon the top flange of said subjacent panel, j. an insulation member received snugly between and against said top flange and said foot flange and against the interior surface of said face member in an insulating position, k. said insulation member having a substantially uniform thickness at least as great as the front-to-rear dimension of said top flange and substantially greater than the front-to-rear dimension of said foot flange, and l. securing means retaining said insulation member in said insulating position.

2. The invention according to claim 1 in which said securing means for retaining said insulation member comprises a rigid strap member having an upper end portion fixed to said attaching flange and having a lower end portion received between said lapping portion and said connecting flange for holding said insulation member in said insulating position.

3. The invention according to claim 1 in which said insulation panel comprises an upper panel and further comprising a subjacent insulation panel having a planar face member, a top flange, an attaching flange, a connecting flange, a foot flange, a lapping portion, an insulation member and securing means identical in construction to the corresponding parts of said upper panel, a second fastener member similar in construction to the fastener member of said upper panel, said second fastener member extending through the opening in the attaching flange of said subjacent panel and securing said attaching flange to a support member, the foot flange of said upper panel being seated on the top flange of said subjacent panel so that said upper panel and said subjacent panel are in substantial vertical alignment and the lapping portion of said upper panel depends in front of the face member of said subjacent panel, and a third fastener member projecting through the lapping portion of said upper panel and into the face member of said subjacent panel for securing said panels together, said second fastener member being covered by said upper panel.

4. The invention according to claim 1 in which said top flange is planar and substantially perpendicular to said face member, and said foot flange is planar and substantially perpendicular to said face member.

* * * * *